United States Patent [19]

Theurer et al.

[11] Patent Number: 4,862,806

[45] Date of Patent: Sep. 5, 1989

[54] MOBILE TIE GANG APPARATUS AND TIE EXCHANGE METHOD

[75] Inventors: Josef Theurer, Vienna; Herbert Wörgötter, Linz, all of Austria

[73] Assignee: Franz Plasser Bahnbaumaschinen-Industriegesellschaft m.b.H., Vienna, Austria

[21] Appl. No.: 165,509

[22] Filed: Mar. 8, 1988

[30] Foreign Application Priority Data

Jul. 23, 1987 [AT] Austria ..... 1872/87

[51] Int. Cl.[4] ..... E01B 29/10

[52] U.S. Cl. ..... 104/7.2; 104/9

[58] Field of Search ..... 104/2, 701, 7.2, 8, 104/9, 10, 12, 307, 7.3; 37/104; 212/220; 414/339

[56] References Cited

U.S. PATENT DOCUMENTS

| | | | |
|---|---|---|---|
| 1,765,023 | 6/1930 | McWane | 212/220 X |
| 4,175,902 | 11/1979 | Herzog et al. | 414/339 |
| 4,178,237 | 12/1979 | Theurer | 104/307 X |
| 4,190,394 | 2/1980 | Herzog et al. | 414/339 X |
| 4,253,398 | 3/1981 | Theurer et al. | 104/2 |
| 4,301,738 | 11/1981 | Theurer | 104/2 |
| 4,418,625 | 12/1983 | Allmer | 104/9 |
| 4,534,295 | 8/1985 | Theurer | 104/12 X |
| 4,611,541 | 9/1986 | Theurer | 104/2 |
| 4,635,557 | 1/1987 | Mohr et al. | 104/12 X |

FOREIGN PATENT DOCUMENTS

| | | | |
|---|---|---|---|
| 2230202 | 8/1973 | Fed. Rep. of Germany . | |
| 91209 | 8/1978 | Japan | 104/9 |
| 805675 | 11/1958 | United Kingdom | 104/2 |

OTHER PUBLICATIONS

"Progressive Railroading", Feb, 78, p. 68; Mar. 84, p. 93/4; Feb. 86, p. 45/6.

"Railway Track Structures", Dec. 68, pp. 14–16; Jun. 78, pp. 28, 29 & 31; Nov. 83, pp. 22–24; Sep. 85, pp. 49, 54, 58, 61, 66, 105 & 106.

*Primary Examiner*—Robert B. Reeves
*Assistant Examiner*—Frank H. Williams, Jr.
*Attorney, Agent, or Firm*—Kurt Kelman

[57] ABSTRACT

A mobile apparatus for sequentially exchanging selected consecutive groups of old ties in an existing railroad track for groups of new ties while retaining groups of old ties therebetween to support the mobile apparatus on the track, comprises at least one bridge-like work vehicle having a frame defining an upwardly recessed portion between respective ends thereof, swivel trucks supporting the work vehicle frame ends on the railroad track, and a drive for the continuous advancement of the work vehicle on the railroad track in an operating direction. A succession of different individual devices are longitudinally displaceably mounted in the recessed frame portion of a respective work vehicle and are operative to effectuate different sequential operations for exchanging the selected old ties for the new ties, the tie exchanging devices including at least one tie pulling and inserting device. A respective drive displaces each individual tie exchanging device with respect to the respective work vehicle frame along a displacement path extending in the direction of the longitudinal extension of the work vehicle frame. A vertical tie conveyor and tie transporting device is associated with each tie pulling and inserting device, and an auxiliary carrier frame is mounted in the recessed frame portion and is connected thereto, each tie pulling and inserting device and the associated vertical tie conveyor and tie transporting device being supported on the auxiliary frame. A continuous guide track extends atop the work vehicle frame, and a power-driven crane is movable along the guide track for transporting the ties.

26 Claims, 5 Drawing Sheets

MOBILE TIE GANG APPARATUS AND TIE EXCHANGE METHOD

BACKGROUND OF THE INVENTION

1. Field of the Invention

The present invention relates to a mobile apparatus or machine combination and a method for sequentially exchanging selected consecutive groups of old ties in an existing railroad track, for example every third or fourth tie of the track or groups of, say, three adjacent old ties, for groups of new ties while retaining groups of, say, three adjacent old ties therebetween to support the mobile apparatus on the track, by means of a succession of different individual devices operatively coordinated to effectuate different sequential operations for exchanging the selected old ties for the new ties. Preferably, this apparatus is combined with a train for loading, transporting and unloading the ties on, in and from open top railroad cars.

2. Description of the Prior Art

U.S. Pat. No. 4,253,398, dated March 3, 1981, discloses a mobile apparatus for the continuous sequential replacement of all old ties of a track with a track renewal train which removes the old ties and lays the new ties while the track rails are lifted and spread apart.

U.S. Pat. No. 4,611,541, dated Sept. 16, 1986, discloses a continuously advancing ballast cleaning machine with tie replacement devices, wherein the ballast is excavated, cleaned and returned while the track is raised a substantial amount. The tie pulling and inserting devices are mounted between the swivel trucks supporting the respective ends of the ballast cleaning machine frame and are connected to longitudinal displacement drives. These devices are used only when an obstacle hindering the operation of the ballast excavating chain is encountered on the shoulder of the track, i.e. they are merely auxiliary means in the ballast cleaning machine for occasional use. No control or control cab for operation of the auxiliary tie replacement devices is indicated.

U.S. Pat. No. 4,301,738, dated Nov. 24, 1981, discloses an apparatus for the replacement of track rails, which comprises two successive work vehicles with projecting, cantilevered machine frame portions. The leading work vehicle carries longitudinally displaceable tools for pulling spikes and devices for lifting and spreading the rails as well as a vertically adjustable receptacle, including a magnetic drum, for the pulled spikes. The trailing work vehicle carries a crib broom, a device for placing and inserting tie plates and a tool for driving the spikes into the ties. The machine has no means for replacing some or all of the ties.

German patent No. 2,230,202, of Aug. 16, 1973, discloses a device for clearing ballast from a track bed. This ballast removing device or scarifier comprises plate-shaped ballast clearing and planing tools which are vertically and laterally adjustably mounted on a cantilevered front portion of the machine frame. The ballast removing plates are preceded by a longitudinally displaceable push rod which may be driven to push a respective tie whose fastening elements have been slightly loosened to enable the ballast removing plates to push the ballast under the displaced tie towards the track shoulder.

It is also known, and has been widely practiced, to exchange only groups of ties in an existing track, for example every third or fourth tie or groups of adjacent ties between ties retained in the track to enable the same to support rolling stock traveling thereover, which is the technology to which the present invention relates. Such a partial tie exchange or renewal is repeated every few years until all the ties of the track has been replaced. Such a mechanized tie gang has been described on pages 22 to 24 of "Railway Track and Structures", November 1983. This mechanized tie gang comprises up to 24 pieces of equipment, such mechanized tie as tie cranes, spike pullers, tie shears, tie cranes for handling tie butts, rotary scarifiers, tie injectors, tampers, rail lifts, spikers and ballast regulators. In the operation of this tie gang, the old ties are withdrawn and placed on the shoulders of the track after optionally being sawn into chunks and they are then loaded onto railroad cars. The new ties are placed on the track shoulders for insertion. The loading and unloading of the ties may be effected at a different time than the tie exchange operation.

The mobile tie exchange apparatus comprises a succession of coordinated and different individual devices operative to effectuate different sequential operations for exchanging the selected ties, such as tie exchange operating devices equipped for pulling spikes, removing old tie plates, withdrawing old ties, scarifying the ballast, inserting new ties, placing new tie plates and driving new spikes. These tie exchange operating devices are suitably spaced from each other in the direction of the railroad track for coordinated operation. Some of such devices are shown in the September 1985 issue of "Railway Track and Structures", including the tie remover/inserter described and illustrated on pages 49 and 64, the self-propelled tie saw on page 58, the spike puller and hydraulic track lifter on page 61, the mechanized plate handling machine on page 66, the anchor tightening machine on page 105, and the spike setter-driver on page 106. Each of these machines are individually operated, self-propelled devices having their own undercarriages for supporting them on the railroad track.

In addition to the above-mentioned mechanized tie gang, other tie-renewal gangs are described on pages 28, 29 and 31 of "Railway Track and Structures", June 1978, and on pages 14 to 16 of the December 1968 issue of this publication. All of these known mechanized tie gangs are comprised of varying numbers of some 14 to 24 individual self-propelled machines, operating personnel being stationed between some of these machines for effectuating additionally required operating steps. The exchange of every third or fourth tie is effected with these known mechanized tie gangs by first removing the tie clips or anchors from the track, then pulling the spikes, removing the old tie plates, withdrawing every third or fourth tie, optionally sawing the withdrawn tie into chunks, placing the withdrawn ties or tie chunks on the track shoulder, scarifying the ballast, i.e. excavating it, in the areas of the track bed which supported the withdrawn ties, inserting new ties in these scarified track bed areas, the new ties having been conveyed to, or stored on, the track shoulder laterally adjacent these areas, whereupon new tie plates are inserted between the inserted new ties and the slightly raised railroad track rails, the new ties are tamped, new spikes are driven into the new ties to fasten the rails thereto, and the tie clips or anchors are applied again. In this connection, an independently operating tie plate distributor car, such as described and illustrated on pages 93 and 94 of "Progressive Railroading", March 1984, may be used for transporting and storing the old and new tie plates.

A tie renewal operation with the individual machines hereinabove described does not only require a large number of operators, including control and monitoring personnel, but also blocks long track sections and their neighboring tracks for a long time so that train traffic is interrupted for extended periods. The efficiency is low because it is exceedingly difficult to coordinate the operation of the many individual machines which are spaced from each other along the railroad track, causing numerous interruptions in the operation. In addition, if an attempt is made to pass some trains on a neighboring track even at low speed, the operators are exposed to danger. The mechanized tie gangs of the prior art, as exemplified hereinabove, does not produce accurate work since it is often difficult, if not impossible, properly to coordinate the operation of the individual machines and to align them exactly with the track line and level for their designated work.

Commonly assigned U.S. patent application application Ser. Nos. 97,757, 97,759 and 97,760, all filed Sept. 17, 1987, disclose a mobile tie replacement apparatus which comprises at least one elongated bridge-like work vehicle having two undercarriages supporting respective opposite ends of the work vehicle on the railroad track, and a succession of different individual devices mounted on the work vehicle or vehicles between the undercarriages and operative to effectuate different sequential operations for exchanging the selected old ties for the new ties. The present invention provides specific improvements in such an apparatus.

U.S. Pat. Nos. 4,175,902, dated Nov. 27, 1979, and 4,190,394, dated Feb. 26, 1980, disclose an apparatus and method for loading and unloading open top or gondola railroad cars for transport of the ties used in such a tie exchange operation. The apparatus comprises a train mounted for mobility along the railroad track and includes a plurality of the open top railroad cars having a considerable loading volume, adjacent ones of the railroad cars being coupled together and each railroad car having two high parallel side walls with top edges and two high end walls, the end walls of the adjacent railroad cars defining respective gaps therebetween, and a power-driven crane with booms for loading and unloading the ties and having two undercarriages supporting the crane for mobility in the direction of the railroad track. The undercarriages have pneumatic tires to enable the crane to be moved along a road or the railroad track, and the crane also has pivoted gliding feet or brackets for gripping the top edges, the relatively widely spaced top edges of the railroad cars serving as a track for moving the crane along the cars while the gliding feet grip the top edges. A cable is attached to the crane to pull the crane along the railroad cars as it is perched atop the cars. Operation of this apparatus requires great skill and a number of sometimes life-threatening manual steps. The movement of the crane between adjacent cars is particularly difficult and very time-consuming, which considerably reduces the efficiency of the operation. The crane movement along and between the cars is quite unstable, providing unsafe operating conditions and frequent interruptions. In addition, the tractor used for the crane must be specially designed to enable the crane to effectuate the required forward and rearward movements on the top edges of the gondola cars.

The old and new ties may be loaded, transported and unloaded at the same time or another time by a mobile loader and unloader installation of the first-described type. After the tie exchange has been completed, the ballast supporting the track may be regulated and shaped, and the track ties may be tamped, with a concomitant track correction, for example by means of a track tamping, leveling and lining machine of the type disclosed in U.S. Pat. No. 4,534,295, dated Aug. 13, 1985.

SUMMARY OF THE INVENTION

It is the primary object of the present invention to improve apparatus for sequentially exchanging selected consecutive groups of old ties, such as three ties at a time, for groups of new ties while retaining groups of old ties between the selected old ties for support of the mobile apparatus on the railroad track so that the withdrawal of the old ties from the track and the insertion of the new ties may be effected more efficiently, simply and safely.

The above and other objects are accomplished in accordance with this invention with a mobile apparatus which comprises at least one bridge-like work vehicle having a frame defining an upwardly recessed portion between respective ends thereof, swivel trucks supporting the work vehicle frame ends on the railroad track, and a drive for the continuous advancement of the work vehicle on the railroad track in an operating direction. A succession of different individual devices is mounted in the recessed frame portion of a respective work vehicle and the devices are operative to effectuate different sequential operations for exchanging the selected old ties for the new ties, the tie exchanging devices including at least one tie pulling and inserting device arranged for longitudinal displacement. A respective drive displaces each individual tie exchanging device with respect to the respective work vehicle frame along a displacement path extending in the direction of the longitudinal extension of the work vehicle frame. A vertical tie conveyor is associated with each tie pulling and inserting device, and a tie transporting device is arranged between each tie pulling and inserting device and the associated vertical tie conveyor. An auxiliary carrier frame is mounted in the recessed frame portion of the respective work vehicle and is connected thereto, each tie pulling and inserting device and the associated vertical tie conveyor and tie transporting device being supported on the auxiliary frame. A continuous guide track extends atop the work vehicle frame, and a power-driven crane is movable along the guide track for transporting the ties.

This surprisingly simple, yet advantageous arrangement of the tie pulling and inserting devices associated with a tie transporting device and a vertical tie conveyor on an auxiliary carrier frame which moves with, and is part of, a continuously advancing single apparatus provides a particularly rational tie exchange operation since the withdrawn old ties may be directly transported and upwardly conveyed to the top of the work vehicle after they are pulled out of the railroad track, and the powder-driven crane can then take them away directly to an open-top freight car coupled to the apparatus. In the same, but reverse, manner, the new ties are supplied to the tie inserting device.

This efficient and continuous tie exchange operation is further enhanced because the mobile apparatus of the invention enables the efficient tie transport to be combined on a common work vehicle or train of work vehicles with the operationally advantageous and coordinated arrangement of a succession of individual tie exchanging devices operative to effectuate different sequential operations for exchanging selected old ties for the new ties. The transport of the ties atop the work vehicle or vehicles enables the tie exchanging devices mounted in the recessed work vehicle frame portion to operate without interference by the tie transport. The capacity of the power-driven crane to transport stacks of ties further improves the transport capacity. The arrangement of the successive tie exchanging devices on at least one work vehicle enables the many individual operations required to be readily controlled in a continuously proceeding tie exchange. The operating speed of the individual devices may be so coordinated that the most economical overall effect is achieved. Since each individual tie exchanging device is longitudinally displaceable and has its own displacement drive, the work vehicles may advance non-stop while operators of these devices control the displacement thereof relative to the work vehicle in a direction opposite to the operating direction so that the devices will be held stationary relative to the railroad track for the relatively brief intervals during which they are in operation. Preferably, an operator's accommodation is arranged within view of each tie exchange device. In this manner, the entire mobile apparatus will continuously advance during the tie exchange operation while the individual operations are effectuated efficiently and without interference.

The present invention also provides a method for sequentially exchanging selected consecutive groups of old ties for groups of new ties while retaining groups of old ties between the selected old ties in a railroad track consisting of two rails fastened to the ties supported on ballast. This method comprises the steps of continuously advancing at least one elongated bridge-like work vehicle along the track in an operating direction while supporting respective opposite ends of the work vehicle on the track on respective swivel trucks, and sequentially operating a succession of different individual devices displaceably mounted on the work vehicle in the operating direction between the undercarriages while continously advancing the work vehicle to (1) remove spikes fastening the rails to the selected old ties whereby the selected old ties are detached from the rails, (2) clear the ballast adjacent an end of the selected old ties from which the spikes have been removed to provide an area free of ballast adjacent the tie end, (3) withdraw the detached old ties laterally from the track to about at least a third of their length while lifting the railroad track, (4) pull the partially withdrawn old ties laterally completely out of the railroad track, (5) clear and plane the ballast in an area whence the olds ties have been withdrawn, (6) insert the new ties in the cleared and planed ballast area, and (7) tamp ballast under the new ties.

The removed spikes and the tie plates are collected from the old ties, the withdrawn old ties are transported to a freight car continuously advancing with the work vehicle, the new ties transported and conveyed sequentially to this area from a freight car continuously advancing with the work vehicle, the tie plates are placed between the new ties and the rails, and the different individual operating devices are displaced along the elongated work vehicle for effectuating the sequential operation thereof while the work vehicle advances continuously.

Since the old ties are pulled and the new ties are inserted at a distance therefrom while the entire mobile apparatus advances non-stop, the tie exchange operation is highly efficient and economical. The rapid tie replacement is facilitated by the clearance of the ballast surrounding the tie end before the ties are pulled out of the railroad track. Furthermore, the time required for this tie withdrawl operation is substantially shortened because of the stepwise lateral displacement of the ties out of the track. Since the new ties are tamped, the railroad track is ready for high-speed train traffic immediately after the partial tie exchange operation so that the same may be effectuated during relatively short intervals between trains. Since the apparatus advances continuously and only the relatively light individual tie exchanging devices are displaced relative to the work vehicles during this continuous advance, the power waste due to a cyclic stop-and-go operation of the entire apparatus is avoided. The new ties may be conveyed and positioned in proper alignment so that they may be readily gripped by the tie inserting device, which further reduces the operating time, the transport of the old and new ties being effected in a closed cycle.

The above and other objects, advantages and features of this invention will become more apparent from the following detailed description of certain now preferred embodiments thereof, taken in conjunction with the accompanying somewhat schematic drawing.

DESCRIPTION OF THE PREFERRED EMBODIMENTS

Figures 1, 2, 3, 4:
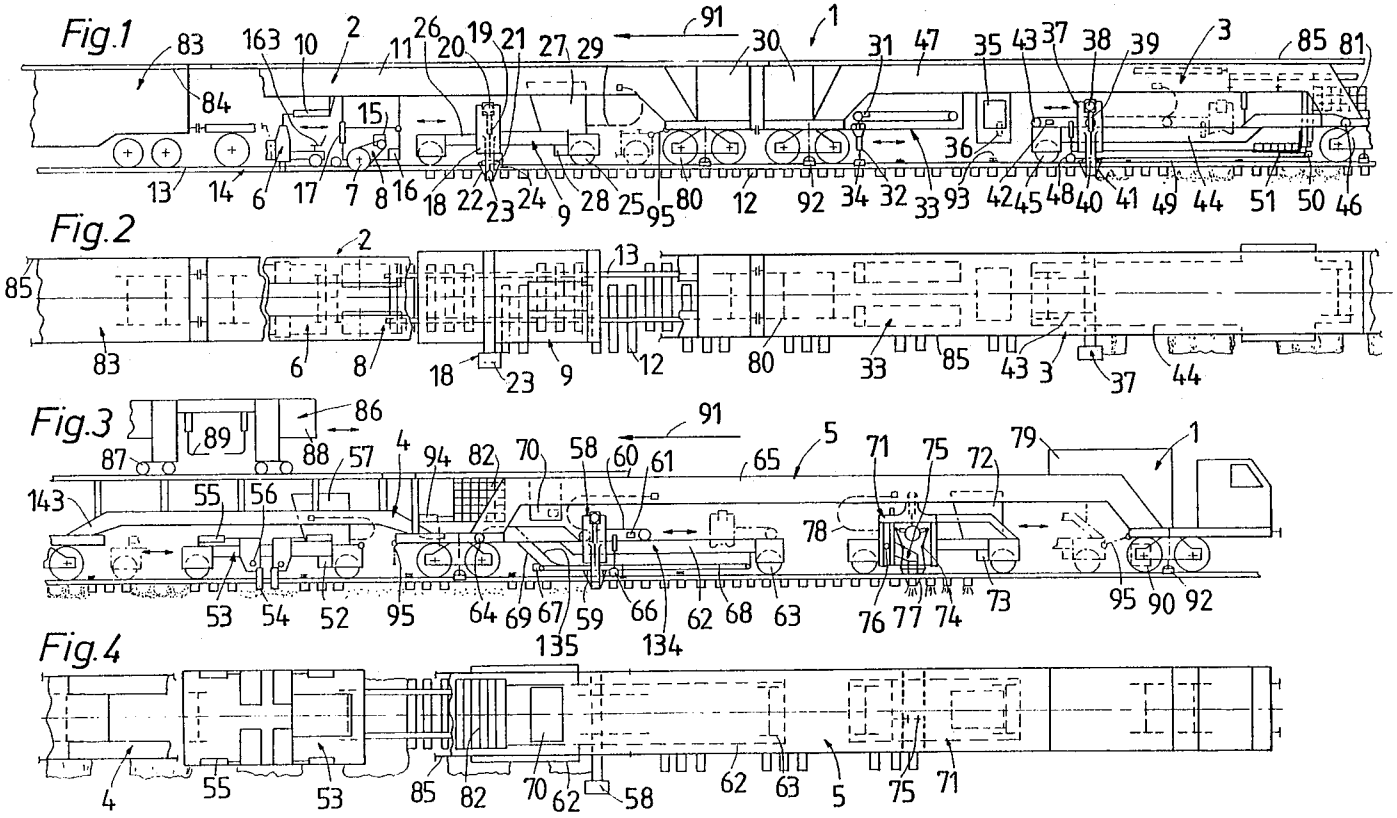
FIG. 1 is a side elevational view of the forward portion of a mobile apparatus according to the invention.
FIG. 2 is a top view of FIG. 1.
FIG. 3 is a side elevational view of the rear portion of the apparatus of this embodiment.
FIG. 4 is a top view of FIG. 3.

Referring now to the drawing and first to FIGS. 1 to 4, there is shown mobile apparatus 1 for sequentially exchanging selected consecutive groups of old ties 12 in existing railroad track 14 for groups of new ties while retaining groups of old ties therebetween to support the mobile apparatus on the track. The illustrated mobile apparatus comprises a succession of work vehicles coupled together, including first, second, third and fourth work vehicles 2, 3, 4 and 5, the coupled together work vehicles forming a train. Each bridge-like work vehicle has a frame 11 defining an upwardly recessed portion between respective ends thereof. using such a train of work vehicles has the advantage that the sequential arrangement of different tie exchanging devices on the succession of work vehicles will automatically center the devices with respect to the railroad track even in sharp curves. On the other hand, these devices can be spaced at a sufficient distance so that a mutual interference of the operation of these devices will be dependably avoided.

Swivel trucks 80 support the work vehicle frame ends on railroad track 14 and drive 90 (at the right of FIG. 3) is designed for the continuous advancement of the work vehicles in an operating direction indicated by arrow 91. The drive may also be provided by a locomotive or a self-propelled freight car 83 to which the work vehicles are coupled. Preferably, the swivel trucks have two axles spaced from each other in the operating direction by a distance corresponding to at least three crib widths. The use of swivel trucks reduces the pressure of the work vehicles on the railroad track from which some of the supporting ties have been withdrawn and the two-axled swivel trucks have the advantage that one of the axles will still run on a track section supported on a tie while the other axle is aligned with an adjacent track section with has no ties.

A succession of different individual devices are mounted in the recessed portions of the work vehicle frames and are operative to effectuate different sequential operations for exchanging selected old ties 12 for the new ties, the tie exchanging devices including first tie pulling and inserting device 37 on work vehicle 3, which serves to pull selected old ties 12 and precedes second tie pulling and inserting device 58 on work vehicle 5, which serves to insert the new ties, the tie pulling and inserting devices being arranged for longitudinal displacement within view of an operator's accommodation illustrated in the present embodiment as operator's cabs 35 and 70 respectively mounted in the recessed frame portion of work vehicles 3 and 5. Respective drive 42 and 61 displaces tie pulling device 37 and tie inserting device 58 with respect to frame 11 of work vehicles 3 and 5 along a displacement path in the direction of the longitudinal extension of the work vehicle frame.

The first work vehicle carries track-bound double-spike puller 6 longitudinally displaceably mounted in the recessed frame portion of the first work vehicle, track-bound spike collecting device 8 comprising magnetic drum 7 arranged to receive spikes pulled by the spike puller, the spike puller and spike collecting device having flanged wheels for rolling support on the track rails, and track-bound self-propelled ballast clearing device 9 longitudinally displaceably mounted in the recessed frame portion of work vehicle 2.

A respective double-spike puller 6 is associated with each rail 13 for pulling spikes at both sides of the rail and has an operator's seat for controlling the spike pulling operation. Longitudinal displacement drive 10 connects spike puller 6 to machine frame 11 of work vehicle 2 for displacement in the upwardly recessed frame portion of the work vehicle above track 14. Magnetic drum 7 of spike collecting device 8 is rotatable counterclockwise by drive 15 and precedes a spike collecting receptable 16 for storing the spikes moved thereto by rotating drum 7. A vertical displacement drive 17 is connected to the magnetic drum for lifting the same off the track when apparatus 1 is moved between operating sites.

Figure 8:
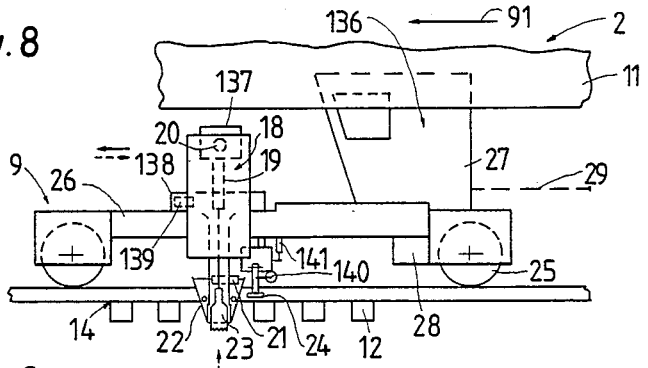
FIG. 8 is an enlarged side elevational view of a ballast scarifier or clearing device with a tie puller according to another preferred feature of the present invention.
Figure 9:
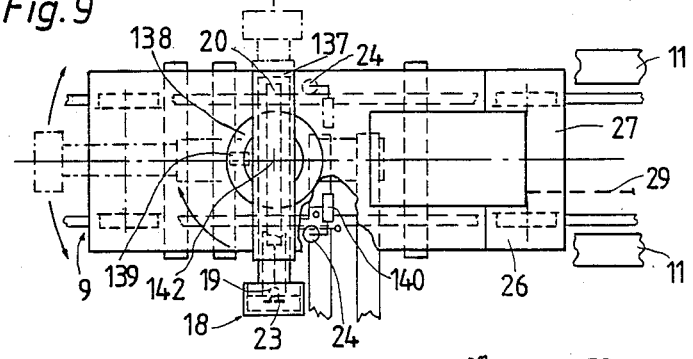
FIG. 9 is a top view of FIG. 8.

As best shown in FIGS. 8 and 9, ballast scarifier or clearing device 9 is mounted on self-propelled work vehicle 136 which includes carriage 26 running on track 14 on flanged wheels 25 and propelled by drive 28, the carriage supporting operator's cab 27 and tie puller 18 which is vertically adjustable by drive 19 and and transversely adjustable by drive 20 along guide 137 extending transversely to carriage 26 for pulling ties 12 a distance corresponding to at least about a third of the tie length. Guide 137 is connected to turntable 138 rotatable by drive 139 relative to carriage 26 about a vertical axis. This enables tie puller 18 to be used at both sides of machine frame 11 of work vehicle 2, i.e. at each rail of railroad track 14. The tie puller comprises tie clamping device 22 pivotal by drive 21 to grip a respective tie 12, shovel-like ballast scarifying element 23 immersible in the ballast adjacent an end of the tie being connected to the tie puller in the range of the tie clamping device for clearing the ballast adjacent the end of the tie to be pulled. Lifting plate 24 is arranged at the lower end of tie puller 18 and may be moved into engagement with the rail head by drive 140, another vertical adjustment drive 141 enabling the lifting plate to be slightly raised with the engaged rail. As will be noted from FIG. 9, another such lifting plate arrangement is provided at the opposite rail. This is used when the tie puller is rotated about vertical axis 142 by drive 139 into the position shown in chain-dotted lines at the opposite rail. The central position of tie puller 18, also shown in chain-dotted lines in FIG. 9, is assumed when the apparatus is moved between operating sites. This simple arrangement in the initial portion of train 1 enables ballast to be cleared away rapidly from the old ties to be withdrawn to facilitate their withdrawal and the tie puller simplifies the following tie pulling device because it shortens its tie withdrawal stroke so as to assure the unhindered continuous advance of the train while the tie exchange operation proceeds.

The drives of ballast scarifier 9 are hydraulically operated and receive their hydraulic power through flexible hoses 29 from central power supply 30.

An auxiliary carrier frame 44 is mounted in the recessed frame portion of second bridge-like work vehicle 3, which follows first work vehicle 2, first tie pulling and inserting device 37 serving to pull the old ties, a vertical tie conveyor 51 and tie transporting device 49 being mounted on auxiliary carrier frame 44. Operator's cab 35 is mounted in the recessed frame portion of second work vehicle 3 within view of tie pulling device 37. One of the individual tie exchange devices is tie plate transporting device 33 mounted in the recessed frame portion of the second work vehicle and preceding cab 35 within view thereof, the tie plate transporting device including drive means 31, 32 for lifting respective ones of the tie plates by magnet 34 and displacing the lifted tie plates longitudinally. The first tie pulling and inserting device succeeds operator's cab 35 and is within view thereof. This simple tie plate transporting device enables the removed tie plates to be removed rapidly from the ties and, preferably, to be laid at 93 on the next tie retained in the railroad track whence it may be taken and laid on the newly inserted tie later.

Figure 5:
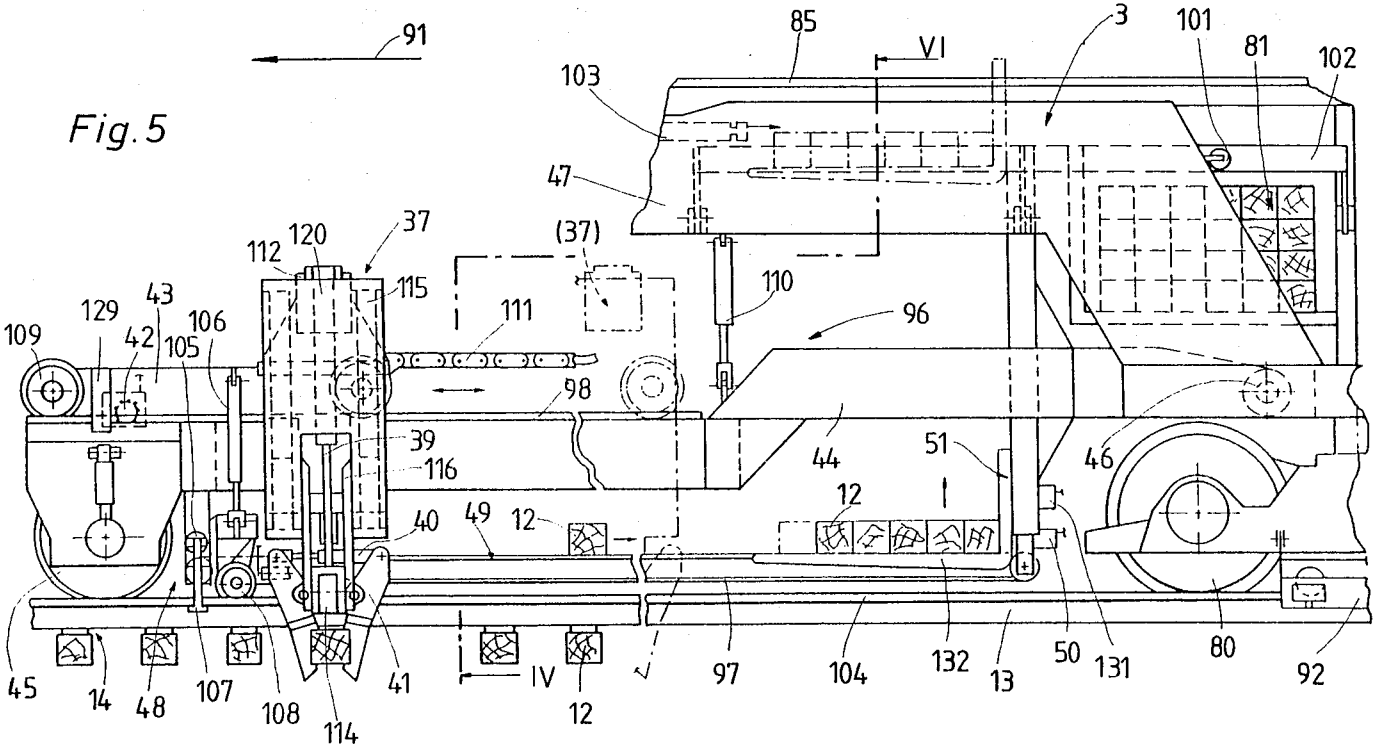
FIG. 5 is an enlarged side elevational view of a structural unit comprised of an auxiliary carrier frame with a tie pulling device, a vertical tie conveyor and a tie transporting device therebetween according to a preferred feature of the invention.
Figure 7:
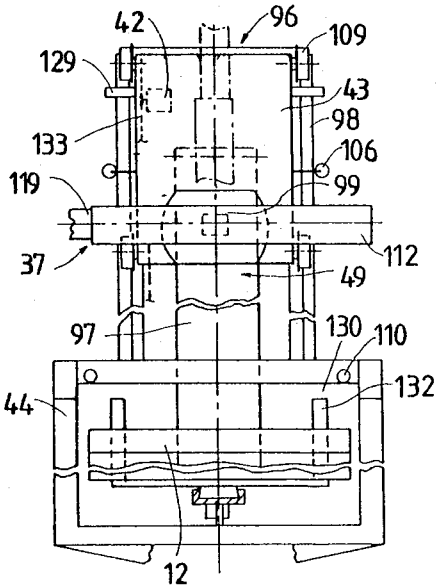
FIG. 7 is a smaller top view of the structural unit shown in FIGS. 5 and 6.
Figure 6:
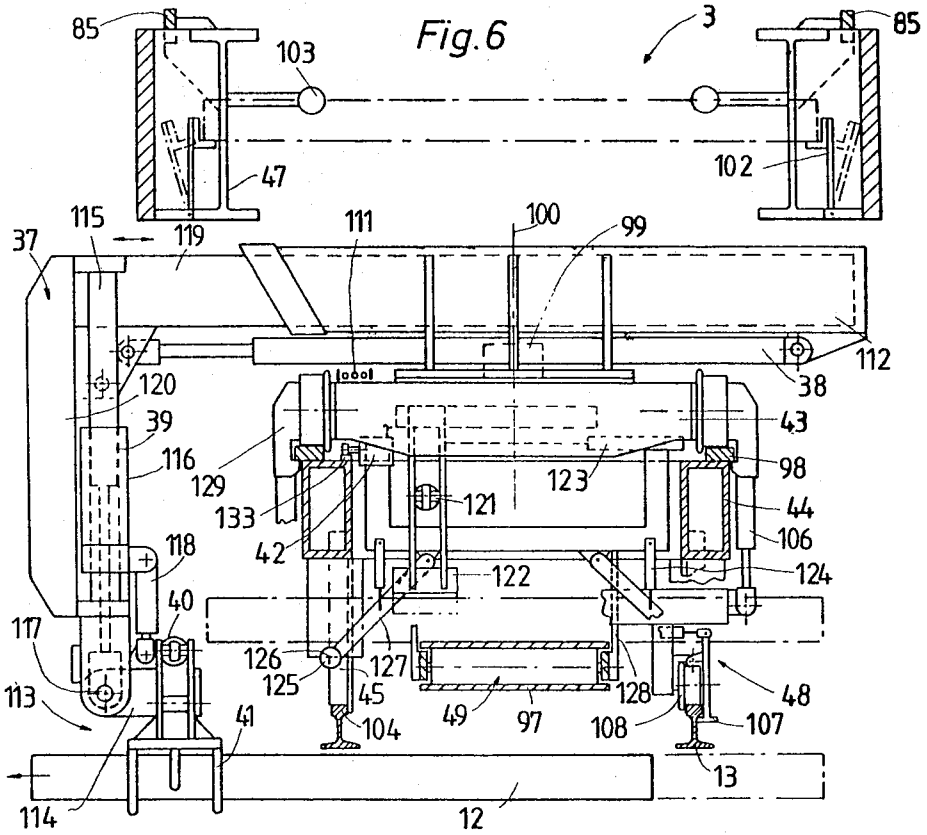
FIG. 6 is a section along line VI—VI of FIG. 5.

As shown in FIGS. 5 to 7, auxiliary frame 44 with tie pulling device 37 and associated vertical tie conveyor 51 and tie transporting device 49 forms structural unit 96, one end of auxiliary carrier frame 44 being linked to the recessed frame portion of work vehicle 3 and an opposite end thereof being supported on the railroad track by undercarriage 45. Undercarriage 45 supports a forward end of auxiliary carrier frame 44 with flanged wheels on track rails 13 while the rear carrier frame end is linked to recessed frame 47 of work vehicle 3 by joint 46. Hydraulic lifting drive 110, which receives hydraulic fluid through flexible hose 111 from central power source 30 on work vehicle 3, connects the auxiliary carrier frame to work vehicle frame 47 for vertically adjusting the auxiliary carrier frame. Vertical tie conveyor 51 and tie transporting device 49 consisting of endless conveyor band 97 are stationarily fixed to auxiliary carrier frame 44. Displacing drive 42 connects tie pulling device 37 to the auxiliary carrier frame for displacement relative thereto between a forward end position shown in full lines in FIG. 5 and a rear end position indicated in chain-dotted lines in this figure. Such a simple and compact structural unit enable the tie pulling and inserting device to be automatically centered over the railroad track since the undercarriage guides the auxiliary carrier frame along the track even in sharp curves.

As best shown in FIG. 6, the tie pulling device comprises tie gripping means 113 including tie clamp 41, drive 40 for operating the tie clamp and drive 39 for vertically displacing the tie clamp. Carriage 43 supports tie gripping means 113 for rotation about vertical axis 100 by drive 99 for rotating the carriage. The carriage is longitudinally displaceable along guide track 98 on auxiliary carrier frame 44 in the operating direction. Tie clamp 41 with its operating drive 40 is mounted on support body 114 which, in turn, is mounted on support body 116 vertically adjustably guided on a pair of vertical guides 115. Drive 39 is connected to support body 116 for vertical adjustment of the tie gripping means. Support body 114 is pivotally mounted on support body 116 for pivoting about transverse axis 117 by pivoting drive 118. Vertical guides 115 are affixed to support 120 connected to carrier beam 119. The carrier beam is telescopingly received in guide element 112 extending transversely to auxiliary carrier frame 44 so that tie gripping means 113 may be displaceed in the transversely extending guide element by drive 38 respectively linked to guide element 112 and to vertical guide 115. By longitudinally displaceably mounting the tie pulling and inserting device on a carriage, the continuous advance of the work train is assured during the stationary positioning of the carriage since the rapid tie gripping movements can be accomplished readily while the carriage is temporarily held stationary. Enabling the tie pulling and inserting device to be turned 180° makes it possible to use it at either rail.

Tie transporting device 49 comprises endless tie collecting conveyor band 97 extending below and parallel to auxiliary carrier frame 44 in the operating direction. Drive 50 operates the conveyor band. Vertically adjustable clamping means 122 consisting of a pair of gripping tongs operated by drive 121 is arranged to grip ties 12 deposited on endless conveyor band 97 and is transversely displaceably mounted on carriage 43, displacement drive 123 connecting the clamping means to the carriage This arrangement makes a rapid tie manipulation possible, the immediate transport of the ties assuring that there will be no interference with the operation of the tie pulling and inserting device.

Vertical tie conveyor 51 comprises two vertically adjustable fork lift elements 132 arranged to support opposite ends of ties 12 deposited on endless conveyor band 97, the fork lift elements extending through opening 130 in the one end of auxiliary carrier frame 44 linked to work vehicle frame 47 and the opening having a width corresponding at least to a tie length. Drive 131 vertically adjusts the fork lift elements between a lower position (shown in full lines in FIG. 5) and an upper position (shown in chain-dotted lines in this figure). Two L-shaped tie retaining ledges 102 are mounted on the work vehicle frame for pivoting about about an axis extending in the operating direction, the tie retaining ledges extending in that direction and being spaced a distance substantially corresponding to a tie length Drive means 101 is arranged to pivot the ledges between a tie retaining position and a tie releasing position respectively shown in FIG. 6 in full and chain-dotted lines. This arrangement of the vertical tie conveyor combined with the two pivotal retaining ledges enables the transfer of layers of ties to the form a stack of ties to be effected simply and effectively. Pivoting of the retaining ledges makes it possible to raise the layers of ties to the level of the retaining ledges and then to retain the raised layer of ties.

Auxiliary carrier frame 44 is held on the railroad track by device 48 comprising hold-down clamping means 107 adjacent undercarriage 45, which is arranged for clampingly engaging at least one rail head 104 of railroad track 14 and is operated by drive 105. The railhead clamping means is connected to carriage 43 of tie pulling device 37 by vertical adjustment drive 106. Holding device 48 is guided along rails 13 of the railroad track by flanged wheels 108 cooperating with the clamping means. This arrangement assures a proper force transmission directly adjacent the tie pulling and inserting device whereby torsion of the auxiliary frame is dependably avoided, regardless of the momentary position of the device on the auxiliary carrier frame.

Vertically adjustable support rollers 125 are arranged at both sides of endless tie collecting conveyor band 97 and the support rollers are rotatable about axes 126 extending in the operating direction. Support arms 127 link the support rollers to an underside of the carriage and drive means 124 link the support arms to the underside of carriage 43 for pivoting the support arms for vertically adjusting the support rollers. This simple arrangement of support rollers provides a secure support for the ties while they are loaded.

Holding brackets 128 connect conveyor band 97 to auxiliary carrier frame 44. To prevent carriage 43 from tilting, it has fork-shaped holding elements 129 undercutting the rails of guide track 98 on auxiliary carrier frame 44. As shown in FIG. 7, longitudinal displacement drive 42 mounted on carriage 43 has a pinion meshing with chain 133 mounted on auxiliary carrier frame 44.

As shown in FIGS. 3 and 4, another auxiliary carrier frame 62 is mounted in the recessed frame portion of fourth bridge-like work vehicle 5, second tie pulling and inserting device 58 serving to insert the new ties, the associated vertical tie conveyor 69 and tie transporting device 68 being mounted on the other auxiliary carrier frame to form structural unit 134. Except for vertical tie conveyor 69, structural unit 134 has the same structure as unit 96 described hereinabove in connection with FIGS. 5 to 7. Another operator's cab 70 is mounted in the recessed frame portion of the fourth work vehicle.

In the same manner as described hereinabove in connection with work vehicle 3, tie inserting device 58 is supported on wheeled carriage 60 slidably mounted on auxiliary frame 62 and connected to longitudinal displacement drive 61 for longitudinally displacing the tie inserting device. Undercarriage 63 supports a rear end of auxiliary carrier frame 62 with flanged wheels on track rails 13 while the forward carrier frame end is linked to recessed frame 65 of work vehicle 5 by joint 64. Vertically adjustable holding clamp 66 is connected to wheeled carriage 60 and slidably grips the head of rail 13. The tie transporting device extends below auxiliary carrier frame 62 and therealong, this device being illustrated as an endless conveyor band mounted on the auxiliary carrier frame and driven by drive 67. Vertical tie conveyor 69 precedes tie inserting device 58 and is connected at the front end of auxiliary carrier frame 62 to machine frame 65. The arrangement of vertical tie conveyor 51 rearwardly of tie puller 37 and of vertical tie conveyor 69 in front of tie inserter 58 has the considerable advantage that the old ties may be stored on train 1 and the new ties may be supplied to the tie inserter directly from the train without the need of depositing the ties on the track shoulders.

The tie pulling operation proceeds in the following manner:

Old ties 12 partially withdrawn by tie puller 18 (FIG. 1) are gripped by tie gripping means 113 (FIG. 5). For this purpose, drive 40 is actuated to move the two tongs of tie clamp 41 together to engage the tie. Drive 38 is then actuated to displace carrier beam 119, support 120 with gripping means 113 and tie 12 transversely. As soon as the tie has been fully withdrawn laterally from railroad track 14, drives 39 and 118 are actuated for vertical adjustment and pivoting of tie 12 about axis 117. In this position, the withdrawn old tie is deposited on support roller 125 and is displaced by drive 38 so far in the direction of endless conveyor band 97 that the tie rests on the support roller and conveyor band when tie clamp 41 is disengaged therefrom. Drive 124 is then actuated to pivot support arms 127 upwardly so that the raised tie may be gripped by tie gripping tongs 122. Actuation of drive 121 causes the tie gripping tongs to engage the tie and drive 123 is then actuated to move the tie gripping tongs with the gripped tie to the right, as seen in FIG. 6, until tie 12 is centered with respect to tie collecting conveyor band 97 (chain-dotted lines). Afterwards, the tie gripping tongs are disengaged from the tie and are raised. Actuation of drive 50 operates the conveyor band to convey the tie to fork lift elements 132 of vertical tie conveyor 51. Meanwhile, a subsequent tie is withdrawn by tie pulling device 37 in the above-described manner. After a layer of six old ties of a tie stack 81 has been deposited on fork lift elements 132, drive 131 is actuated to convey this layer of old ties to retaining ledges 102. As shown in chain-dotted lines in FIG. 6, these retaining ledges have been pivoted out of the way of the upwardly moving ties until they have reached the upper end position, at which time the L-shaped retaining ledges are pivoted into the position indicated in full lines so that the ends of the ties are supported thereon. While the fork lift elements are lowered again, drive 103 is actuated to displace the layer of ties along retaining ledges 102 until they come to rest on stack 81. At this time, the retaining ledges are again pivoted out of engagement with the tie ends so that the ties fall on top of stack 81. Tie pulling device 37, which is longitudinally displaced intermittently for each tie pulling operation by drive 42, is firmly held on rail head 104 by hold-down clamp 107 during each tie pulling operation. This prevents a tilting of the device and auxiliary carrier frame 44 supported on the railroad track by undercariage 45. Actuation of rotating drive 99 enables tie pulling device 37 to be turned 180° so that old ties may be pulled out of the track from the opposite side. When train 1 moves between operating sites, tie pulling device 37 is so pivoted by drive 99 that guide 112 extends in the direction of the track and tie gripping means 113 is close to undercarriage 45 (chain-dotted lines in FIG. 7).

Figure 10:
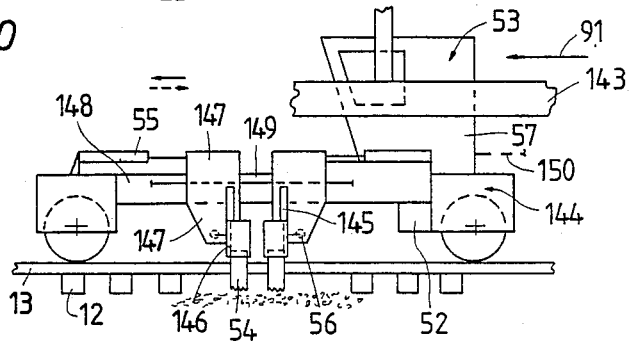
FIG. 10 is also an enlarged side elevational view of another preferred ballast scarifier or clearing device.
Figure 11:
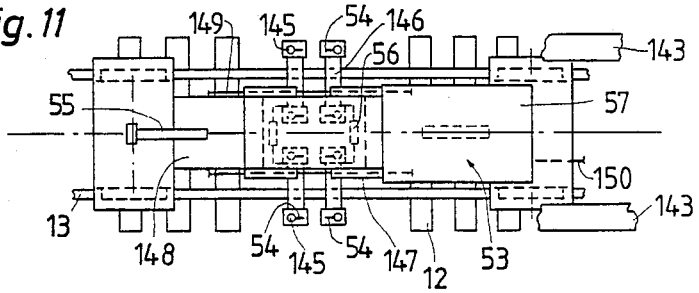
FIG. 11 is a top view of FIG. 10.

As shown at the left in FIGS. 3 and 4, self-propelled device 53 for clearing and planing ballast serving to support the new ties and filling cribs therebetween is arranged between a rear one of the swivel trucks of second work vehicle 3 and a front one of the swivel trucks of fourth work vehicle 5. This track-bound device is shown in detail in FIGS. 10 and 11, and is longitudinally displaceably mounted in upwardly recessed frame portion 143 of third work vehicle 4. It comprises carriage 144 propelled by drive 52 and carrying further operator's cab 57. The carriage of ballast clearing device 53 runs on flanged wheels on the track rails and has two ballast clearing elements 54 associated with each rail and spaced from each other in the operating direction. The ballast clearing elements are displaceable transversely to the operating direction into the shoulders of track 14 adjacent respective tie ends and each ballast clearing element 54 is connected to drives 55 and 145 for independently vertically adjusting and longitudinally displacing the elements and to drive means 56 for transversely displacing the ballast clearing elements for clearing the ballast for support of the new ties and of the cribs between the new ties. Ballast clearing elements 54 are mounted in pairs of tool carriers 146 and are vertically adjustable thereon by drives 145. Each tool carrier 146 is transversely displaceably mounted in guides of carrier bodies 147. Each carrier body 147 is connected to respective longitudinal displacement drive 55 and is mounted in guides 149 of carriage frame 148. The ballast between ties 12 is cleared in the direction of the track shoulders when ballast clearing elements 54 are lowered into engagement with the ballast and displaced transversely to push the ballast to the shoulders. As soon as the ballast clearing operation has been completed, elements 54 are lifted by actuating drives 145 and are transversely displaced again towards the track center. In this position, the next ballast clearing operation is again initiated. The operation of the ballast clearing and planing elements is controlled from cab 57. The drives are again hydraulically operated and connected by flexible hoses 150 to central power supply 79.

Such a simple and compact ballast scarifier enables a ballast area extending over several cribs to be efficiently planed for subsequent support of the new ties in the area between the retained ties. The transverse displaceability of the ballast clearing elements additionally enable the ballast to be cleared at the track shoulders so that the new ties may be readily inserted laterally over a planed shoulder. The arrangement of ballast clearing and planing device 9 ahead of tie pulling device 18 and ballast clearing and planing device 53 ahead of tie inserting device 58 has the advantage of enabling the tie exchange to proceed trouble-free and more rapidly since it will facilitate the work of the stationary devices during the tie exchange operation before they are displaced longitudinally with respect to the respective work vehicle frame so that the speed of the continuous advance of train 1 may be increased.

Vertical tie conveyor 69 on fourth work vehicle 5 is comprised of chute 135 leading from stack 82 of new ties to tie transporting device 68. By operating drive 94, the lowest layer of new ties in stack 82 is pushed in the direction of structural unit 134 until the foremost tie of this layer of ties reaches chute 135 and slides down the chute onto tie transporting device 68. The rear end position of tie inserting device 58 on auxiliary carrier frame 62 is indicated in chain-dotted lines in FIG. 3, longitudinal displacement drive 61 displacing the tie inserting device between this and a forward end position shown in full lines.

Figure 12:
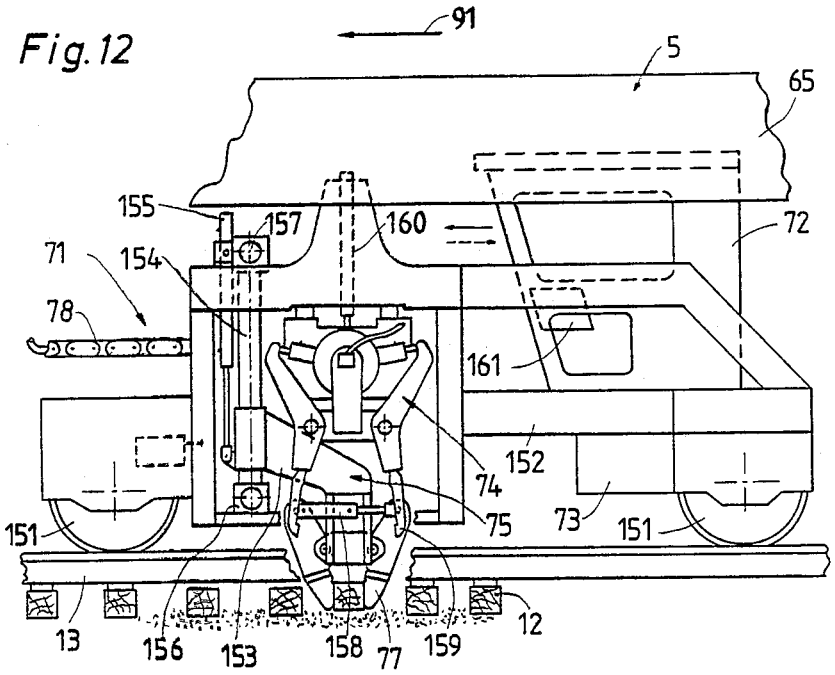
FIG. 12 is an enlarged side elevational view of a tie tamper with a tie positioning device according to a further preferred feature of this invention.
Figure 13:
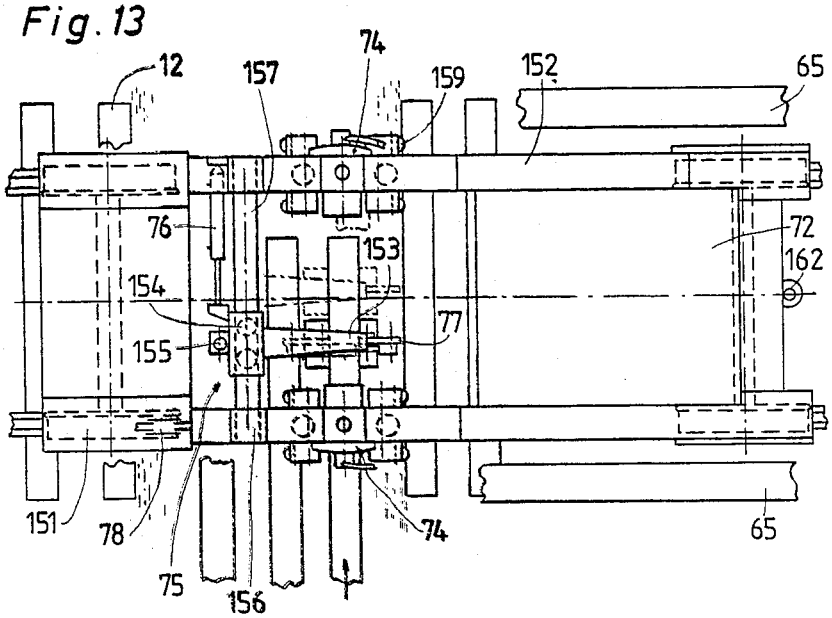
FIG. 13 is a top view of FIG. 12.

As shown in FIGS. 3 and 4, self-propelled tie tamping device 71 is longitudinally displaceably mounted in recessed frame portion 65 of fourth bridge-like work vehicle 5 and succeeds the other auxiliary carrier frame 62 and a further operator's cab 72 is mounted in the recessed frame portion of the bridge-like work vehicle, the tie tamping device being within view of the further operator's cab. As shown in FIGS. 12 and 13, longitudinally displaceable tie tamping device 71 comprises self-propelled carrier frame 152 running on front and rear undercarriages 151 on the track and being propelled by drive 73, cab 72 being mounted on the carrier frame. The carrier frame also supports tamping heads 74 associated with each rail 13 of the railroad track and each tamping head has pairs of vibratory and reciprocatory tamping tools arranged to be immersed in the ballast for tamping the same under the newly inserted ties disposed therebetween. By mounting the tamping heads on a self-propelled carrier frame, the relative displacement of the tamping heads with respect to work vehicle 5 may be effected simply by actuation of drive 73. Furthermore, it assures a centering of the tamping tools relative to the respective rails 13 along the entire longitudinal displacement path of the tamping heads, regardless of the position of the work vehicle. In addition, the undercarriages of the carrier frame press advantageously against the track immediately ahead of, and behind, the tie being tamped.

Tie positioning device 75 is associated with the tie tamping device and is arranged between the tamping heads for positioning the new tie. The tie positioning device is transversely displaceable on the carrier frame by drive 76 connecting the tie positioning device to carrier frame 152. The tie positioning device comprises tie gripping tongs 77 mounted on carrier 153 which is vertically adjustable along two vertical guide posts 154 by drive 155. One end of the guide posts is supported on guide body 156 which is displaceably mounted on on upper and lower horizontal guide posts 157, and may be transversely displaced by drive 76. Clamping drive 158 enables the tie gripping tongs 77 mounted at the lower end of carrier 153 to be adjusted into a tie clamping position. The combination of the tie tamping device with a tie positioning device enables the newly inserted ties to be properly positioned for tamping. The stagewise insertion of the new ties considerably increases the efficiency of the tie insertion operation since partial insertions are effected stepwise, which not only leaves more time for each relative displacement but also causes any ballast resting on the new ties to be stripped therefrom by the rail during insertion.

Tamping tools 159 are vertically adjustable by drive 160. Drive 73 and the operating drives of tie tamping device 71 are hydraulic drives connected by flexible hoses 78 to central power supply 79 and are remote-controlled from control panel 161 in cab 72. FIG. 13 illustrates coupling device 162 for affixing coupling rod 95 when train 1 moves between operating sites.

The specific illustrated arrangement of train 1 advantageously allows the series mounting of the sequentially operating individual tie exchanging devices on a succession of work vehicles as well as the combination thereof with additional work vehicles to provide for a variety of other track maintenance work during the continuous advance of the train. Thus, the work vehicles carrying the tie pulling and inserting devices are preceded by work vehicles with devices for preparing the ties for pulling and inserting, respectively. Thus, the different tie exchanging devices are readily observably mounted on relatively short work vehicles. In this manner, the tie exchange proceeds like on a moving assembly line rapidly, dependably and trouble-free while the train advances continuously. Since each tie exchanging device has its own longitudinal displacement drive, each operator can control its displacement independently and in accordance with prevailing operating conditions. Therefore, the illustrated tie exchange work train provides maximum efficiency, accuracy and uniformity in a most economical manner in a partial tie exchange operation. Individual tie exchange devices which have been effectively used before may be incorporated in the mobile apparatus of the present invention simply by equipping them with wheels for running on the railroad track and longitudinal displacement drives for their intermittently displacement during the continuous advance of the train.

As shown at the right in FIG. 1 and at the left in FIG. 3, storage space for stack 81 of the selected old ties and stack 82 of the new ties respectively is provided above the rear swivel truck of work vehicle 3 and the front swivel truck of work vehicle 5, more particularly at the points where the front and rear ends of third work vehicle 4 are pivotally coupled to the preceding and succeeding work vehicles, respectively. By arranging a storage space for the old and the new ties, respectively, immediately adjacent the respective vertical tie conveyors and preferablt above the swivel trucks supporting the third work vehicle, substantial stacks of ties, which can be transported economically, are stored on the train and the conveyance path of these ties from and to the respective tie transporting devices is considerably shortened. Each stack of ties may be comprised of six layers of seven ties each. As more specifically described in the previously mentioned copending patent applications, coupled work vehicles 2, 3, 4 and 5 form a train with preceding tie transporting car 83, which continuously advances in the operating direction indicated by arrow 91. The tie transporting car is an open-top freight car for loading the ties and had two parallel side walls with top edges 84 extending in the direction of railroad track 14 and continuous guide track 85 extends along the top edges of car 83 and the frames of the work vehicles. Power-driven gantry crane 86 is movable along the guide track for transporting the ties. The crane has front and rear undercarriages each having pairs of flanged wheels 87 running on the rails of continuous guide track 85 and is propelled by drive 88 along the track. It is equipped with four L-shaped gripper arms 89 rotatable about a vertical axis and vertically adjustable for gripping and lifting stacks 81 and 82 of ties. The gripper arms are arranged for cooperatively subtending and thereby supporting a stack of the ties.

Such a gantry crane with four gripper arms enhances the transport efficiency with a reduced number of individual transports since a single transport will move a stack of forty-two ties. The rotation of the gripper arms enables the tie stacks to be lifted out of the open-top freight car without any problems since the gripper arms pivoted into a position extending transversely to the operating direction may be readily lowered into a gap between two stacks.

Each work vehicle 2, 3, 4 and 5 of train 1 has an upwardly recessed frame portion 11, 47, 143 and 65, respectively, for housing the individual different tie exchanging device, such as spike puller 6, ballast clearing device 9, tie pulling device 37, ballast clearing and planing device 53, tie inserting device 58 and tie tamping device 71, and enabling these devices to be longitudinally displaced relative to the respective work vehicles without hindrance and without interfering with the tie transport on top of the vehicles by power-driven crane 86. Except for spike collecting device 8, each tie exchange device has its own operator. The operator of double-spike puller 6 is located on operator's seat 163 providing a clear view over the spikes to be pulled. The ballast clearing device 9 is controlled by an operator in cab 27 permitting a clear view of the tie end to be gripped by tie clamp 22 during the pulling operation. Tie pulling device 37 as well as tie plate transporting device 33 are controlled from cab 35 which also provides a clear view of tie clamp 41 and tie transporting device 49. However, it would also be possible to operate tie plate transporting device 33 by remote-control by an operator walking along the track. Ballast clearing elements 54 of ballast clearing device 53 are controlled by an operator in cab 57 and an operator in cab 70 controls tie inserting device 58 which also permits a clear view of tie transporting device 68. The operator in cab 72 controls tie positioning device 75 as well as tamping heads 74.

As shown at right in FIG. 3, drive 90 advances train 1 non-stop in the operating direction indicated by arrow 91. To assure safe running of two-axled swivel trucks 80 on track rails 13, particularly when, for instance, groups of three successive ties are exchanged between groups of three retained ties, the swivel trucks are equipped with rail guide elements 92 which securely maintain the gage of track 14 and prevent the rails from spreading in the track section temporarily free of supporting ties, and also forceably guide the swivel trucks along the railroad track.

As shown at right in FIG. 1, a stack of collected tie plates resting on a retained old tie 12 is designated by reference numeral 93.

In FIG. 3, preferably hydraulically operated drive 94 is shown at the rear end of work vehicle 4 for movement against the lowest layer of stack 82 of new ties. Coupling rod 95 can be connected to tie tamper 71 at the rear end of work vehicle 5 to move the tamper with the work vehicle when train 1 is moved from one operating site to another.

Tie exchange work train 1 illustrated in FIGS. 1 to 4 operates in the following manner:

Drive 90 is operated to advance train 1 to the operating site, open-top freight car 83 being loaded with new ties. When the operating site has been reached, operators are placed in the various operator's accommodations on work vehicles 2 to 5 for operation of the individual tie exchange devices while the train is advanced non-stop by drive 90 in an operating direction indicated by arrow 91. The operator on the operator's seat on double-spike puller 6 at each track rail 13 operates the spike pulling tools at the left and right of each rail to pull the spikes out of those old ties which are to be exchanged, for example of a group of three adjacent ties. While the spikes are pulled, drive 10 holds spike puller 6 stationary with respect to track 14. After all the spikes are pulled, longitudinal displacement drive 10 is operated to displace the spike puller to its forward end position with respect to frame 11 of work vehicle 2. In this end position, the spikes are pulled from a succeeding group of old ties. The pulled spikes are collected by operating drive 15 to rotate magnetic drum 7 and transport the magnetically held spikes to storage container 16.

Meanwhile, the operator in cab 27 on first work vehicle 2 operates the vertically adjustable ballast scarifier tools 23 of ballast clearing and planing device 9 to move the ballast away from the end of a respective old tie 12, or group of old ties. This facilitates gripping of the tie end by tie clamping device 22. Drive 20 is now operated to withdraw the tie, from which the spikes were previously pulled, laterally a distance of about one third the tie length. This partial tie withdrawal operation begins while the ballast clearing and planing device is in its foreward end position where it is held stationary during the operation with respect to the track. Since train 1 continuously advances, however, ballast clearing and planing device 9 is continuously displaced rearwardly with respect to the work vehicle into the rear end position indicated in FIG. 1 in dash-dotted lines. In this end position, the ballast clearing and partial tie withdrawal operations have been completed. Drive 28 is now operated for the rapid forward displacement of ballast clearing and planing device 9 into the forward end position to be ready for the succeeding ballast clearing and partial tie withdrawal operation. To facilitate the partial withdrawal of the tie, the track rail in the range of the tie to be withdrawn is momentarily lifted by lifting plate 24.

At the front end of succeeding work vehicle 3, partially withdrawn old ties 12 are sensed by tie plate transport device 33 whose magnet 34 picks up the tie plates loosely lying on these ties. The collected tie plates are then deposited in a strack 93 on next tie 12 retained in track 14. The operator in cab 35 with control panel 36 operates tie plate transport device 33 as well as succeeding tie puller 37. The tie puller has tie gripping tool 41 for gripping the end of each partially withdrawn tie to pull the tie completely out of track 14 by operation of lateral displacement drive 38. Again, tie pulling device 37 remains stationary with respect to track 14 during each tie pulling operation while auxiliary carrier frame 44, which supports the tie pulling device, advances continuously on undercarriage 45 with train 1. Each completely withdrawn tie 12 is lifted onto tie conveyor 49 by vertically adjusting tie gripping tool 41 by drive 39. The tie conveyor transports the old ties to vertical tie conveyor 51. This may be a fork lift arranged, for example, to receive a layer of six ties, after which it is raised to deposit the layer of ties on stack 81 of old ties. To prevent undercarriage 45 from being lifted off track 14 during the tie withdrawal operation, auxiliary carrier frame 44 is held on the track by clamping device 48 which glidably grips the rail head. After tie puller 37 has reached its rear end position indicated in dash-dotted lines in FIG. 1, at which point the tie pulling operation has been completed, it is rapidly advanced to its forward end position by operation of longitudinal displacement drive 42. In this end position, the following tie pulling operation commences.

The ballast in the section of the track bed from which old ties 12 have been withdrawn is smoothed or planed by ballast clearing and planing device 53 carried by work vehicle 4. For this purpose, shovel-shaped ballast clearing elements 54 are transversely and longitudinally displaced by operation of drives 55, 56 to displace the ballast towards the track shoulders. This operation is controlled by an operator in cab 57 and, after the ballast clearing and planing operation has been completed, device 53 is displaced into its forward end position shwon in dash-dotted lines in FIG. 3 by operation of drive 52. The following ballast clearing and planing operation is then effected in this position.

The insertion of the new ties is effected by tie inserter 58 at the front end of work vehicle 5 (see FIG. 3). For this purpose, drive 94 is actuated to push a new tie from stack 82 to the vertical conveyor 69 which is a chute slidingly conveying the new tie to tie transport device 68 where tie gripping device 59 of the tie inserter grips the tie and inserts it laterally into the track. During the tie inserting operation, tie inserter 58 moves relatively to auxiliary carrier frame 62, i.e. it remains stationary with respect to the track. As soon as the tie inserter has reached its rear end position, indicated in dash-dotted lines in FIG. 3, the operator in cab 70 actuates drive 61 to displace the entire tie inserting device with its sliding carriage 60 longitudinally in its front end position shown in full lines. Meanwhile, the next new tie has been moved from stack 82 to tie transporting device 68 so that this tie is ready for insertion. To increase the efficiency of the tie inserting operation, the new ties are inserted into the track only about two thirds of their length, analogously to the tie withdrawal operation with device 18 described hereinabove in connection with FIG. 1. Also analogously to that operation, the new tie is fully inserted by tie positioning device 75 which grips the partially inserted tie and pushes it into the track by actuation of transverse drive 76, any ballast on the tie being removed therefrom as the tie slides under the rails. As soon as the new tie is in its proper position, ballast is tamped under it by tamping device 71 as the tamping device moves relatively to continuously advancing work vehicle 5, i.e. remains stationary with respect to the track. As soon as the tamping device has reached its rear end position, indicated by dash-dotted lines in FIG. 3, the operator in cab 72 actuated drive 73 to move it rapidly back into the front end position indicated in full lines. In this position, the next tie positioning and tamping operation is performed. When the train moves from one operating site to another, tamping device 71 is connected to machine frame 65 of work vehicle 5 by means of coupling rod 95 (shown in dash-dotted lines) to move the tamping device with the work vehicle. The same temporary coupling to work vehicles 2 and 4, respectively, is provided for ballast clearing and planing devices 9 and 53.

While train 1 advances non-stop along the operating site and independently of the operation of the individual tie exchange devices described hereinabove, motor crane 86 transports stacks 81 of odd ties along guide track 85 to tie transport car 83 atop the train. Immediately after a stack of old ties is deposited in the transport car, a stack 82 of new ties is gripped by gripper arms 89 of the crane and is transported to the storage space provided between third and fourth work vehicles 4 and 5.

With the apparatus described hereinabove and illustrated in the accompanying drawings, it is possible sequentially to exchange selected groups of, say, three or four old ties for groups of new ties while retaining groups of old ties between the selected old ties by continuously advancing at least one bridge-like work vehicle 2, 3, 4, 5 along railroad track 14 in an operating direction indicated by arrow 91 while supporting respective opposite ends of the work vehicle on respective swivel trucks 80 while sequentially operating a succession of different individual devices displaceably mounted on the work vehicle or vehicles in the operating direction between the swivel trucks to remove spikes fastening rails 13 to selected old ties 12 whereby the selected old ties are detached from the rails, the removed spikes being collected by device 8, to clear the ballast adjacent an end of the selected old ties from which the spikes have been remove to provide an area free of ballast adjacent the tie end, to withdraw the detached old ties, which have thus been partially freed of embedding ballast, laterally from the track to about at least a third of their length while lifting the railroad track, to collect the tie plates from the detached old ties, to pull the partially withdrawn old ties laterally completely out of the railroad track by tie pulling device 37, the withdrawn old ties being conveyed to freight car 83 continuously advancing with the work vehicles in train 1, to clear and plane the ballast in an area whence the old ties have been withdrawn, to insert the new ties in the clearned and planed ballast area by tie inserting device 58, the new ties being sequentally conveyed to this area from a freight car continuously advancing with the work vehicles, to place tie plates between the new ties and the rails, and to tamp ballast under the new ties by tamping device 71.

The rapid and simultaneous pulling of old tie and insertion of new ties at points spaced along the continuously advancing train makes a highly efficient and economical tie exchange operation possible, the rapid tie exchange being made possible by clearing the ballast from the track shoulders where the old ties are pulled and the new ties inserted. In addition, the tie exchange operation is substantially shortened by the stepwise withdrawal and insertion of the ties. After the tie exchange operation has been completed, the track is ready for high-speed train traffic, thus reducing the downtime of the track. The intermittent longitudinal displacements of the tie exchanging devices enable the entire work train to advance continuously while the tie exchanging devices are temporarily held stationary during their operation. Therefore, it is not necessary to subject the entire train to a stop-and-go advance, which is highly energy-ineffective. The new ties are delivered to the tie inserting device positioned ready for insertion and at a uniform sequence. This further reduces the operating time required for the tie exchange while the old and new ties are transported in a substantially closed operating cycle. All of this makes the operation exceedingly efficient and uniform to assure an accurate track position after the tie exchange.

The new ties may be partially inserted laterally into railroad track 14 to about at least a third of their length and the partially inserted new ties are then completely inserted into the track and positioned for tamping at a section of the track where the tamping is effectuated. The new ties are preferably stacked in layered stack 82 preceding the insertion of the new ties, and the new ties are sequentially conveyed from the layered stack by chute 69 for insertion. The partial insertion assures a shortened insertion time and thus enhances the efficiency of the tie inserting device to assure the trouble-free continuous advance of the work train even where the tie inserting conditions are unfavorable. The final tie insertion and positioning is accomplished just before tamping. The transportation of the ties in stacks from the tie pulling device and to the tie inserting device assures an effective removal and delivery of the old and new ties, respectively, to and from the open-top freight cars despite the relatively long transport path thereto.

What is claimed is:

1. A mobile apparatus for sequentially exchanging selected consecutive groups of old ties in an existing railroad track for groups of new ties while retaining groups of old ties therebetween to support the mobile apparatus on the track, which comprises (a) at least one bridge-like work vehicle having a frame defining an upwardly recessed portion between respective ends thereof, (b) swivel trucks supporting the work vehicle frame ends on the railroad truck, (c) a drive for the continuous advancement of the work vehicle on the railroad track in an operating direction, (d) a succession of individual devices operative to effectuate different sequential operations for exchanging the selected old ties for the new ties, the tie exchanging devices including (1) at least one tie pulling and inserting device mounted for longitudinal displacement in the recessed frame portion of a respective work vehicle for respectively laterally pulling a respective old tie out of the track and laterally inserting a respective new tie into the track, (e) a respective drive for displacing each individual tie exchanging device with respect to the respective work vehicle frame along a displacement path extending in the direction of the longitudinal extension of the work vehicle frame, (f) a vertical tie conveyor associated with each tie pulling and inserting device, (g) a tie transporting device between each tie pulling and inserting device and the associated vertical tie conveyor, (h) an auxiliary carrier frame mounted in the recessed frame portion of the respective work vehicle and connected thereto, each tie pulling and inserting device and the associated vertical tie conveyor and tie transporting device being supported on the auxiliary frame, (i) a continuous guide track extending atop the work vehicle frame, and (j) a power-driven crane movable along the guide track for transporting the ties to and from the vertical tie conveyors.

2. The mobile apparatus of claim 1, further comprising an open-top freight car for loading the ties, the freight car having two parallel side walls with top edges extending in the direction of the, railroad track and the continuous guide track extending beyond the top edges.

3. The mobile apparatus of claim 1, wherein the crane is a gantry crane comprising four L-shaped gripper arms, each gripper arm being rotatable about a vertical axis and being vertically adjustable, the gripper arms being arranged for cooperatively subtending and thereby supporting a stack of the ties.

4. The mobile apparatus of claim 1, comprising a succession of said work vehicles coupled together to form a train and mounting respective ones of said individual tie exchanging devices, the continuous guide track extending atop the work vehicles of said train.

5. The mobile apparatus of claim 4, wherein the tie exchanging devices further include a spike puller and a ballast clearing device combined with a tie puller preceding a first one of the tie pulling and inserting devices in the operating direction, the first tie pulling and inserting device serving to pull a selected one of the old ties, and further comprising a device for collecting the spikes pulled by the spike puller.

6. The mobile apparatus of claim 5, wherein the tie exchanging devices further include a ballast clearing and planing device preceding a succeeding one of the tie pulling and inserting devices for planing areas of the ballast from which the old ties have been pulled, the succeeding tie pulling and inserting device serving to insert the new ties, and further comprising a longitudinally displaceable tamping device combined with a tie positioning device trailing the tie inserting device in the operating direction for positioning the inserted new ties and tamping ballast under the new ties positioned by the tie positioning device, and a drive for longitudinally displacing the tamping device with the tie positioning device.

7. The mobile apparatus of claim 6, wherein the spike puller, the ballast clearing device combined with a tie puller and the device for collecting the spikes pulled by the spike puller are mounted on a first one of the work vehicles in the operating direction, the auxiliary frame supporting the tie pulling device and associated vertical tie conveyor with tie transporting device is mounted in the recessed frame portion of a second one of the work vehicles, and the ballast clearing and planing device is mounted in the recessed frame portion of a third one of the work vehicle, and a respective storage place for a stack of the old ties and of the new ties is provided at the frame ends of the third work vehicle above the swivel trucks supporting the frame ends adjacent a respective one of the vertical tie conveyors.

8. The mobile apparatus of claim 7, wherein the auxiliary frame supporting the tie inserting device and associated vertical tie conveyor with tie transporting device as well as the tamping device combined with the tie positioning device are mounted in the recessed frame portion of a fourth one of the work vehicles.

9. The mobile apparatus of claim 4, wherein a first one of the bridge-like work vehicles in the operating direction carries a track-bound spike puller longitudinally displaceably mounted in the recessed frame portion of the first work vehicle and connected to a longitudinal displacement drive, the spike puller being equipped with an operator's accommodation, a track-bound spike collecting device arranged to receive spikes pulled by the spike puller, the spike collecting device including a magnetic drum, and a track-bound self-propelled ballast clearing device longitudinally displaceably mounted in the recessed frame portion of the first work vehicle, the ballast clearing device including an operator's cab and a tie puller, a second one of the work vehicles carries a tie plate transporting device including longitudinal displacement and lifting drives we well as the auxiliary carrier frame in the recessed frame portion a first one of the tie pulling and inserting devices, the associated vertical tie conveyor and a tie transporting device being mounted on the auxiliary carrier frame, an operator's cab mounted in the recessed frame portion of the first work vehicle within view of the tie plate transporting device and the first tie pulling and inserting device, another one of the auxiliary carrier frames mounted in the recessed frame portion of a fourth one of the bridge-like work vehicles, a second one of the tie pulling and inserting devices, the associated vertical tie conveyor and a tie transporting device being mounted on the other auxiliary carrier frame within view of another operator's cab mounted in the recessed frame portion of the fourth work vehicle, a self-propelled tie tamping device longitudinally displaceably mounted in the recessed frame portion of the fourth work vehicle and succeeding the other auxiliary carrier frame within view of a further operator's cab in at the end of the fourth bridge-like work vehicle, the tie tamping device preceding the further operator's cab, and a third one of the bridge-like work vehicles carries a self-propelled device for clearing and planing ballast serving to support the new ties and filling cribs therebetween, the ballast clearing and planing device including an operator's cab and being arranged between a rear one of the swivel trucks of the second work vehicle and a front one of the swivel trucks of the fourth work vehicle, and a storage space for the selected old ties and the new ties respectively above the rear and front swivel trucks.

10. The mobile apparatus of claim 4, wherein one of the tie exchanging devices is a track-bound ballast clearing device longitudinally displaceably mounted in the recessed frame portion of one of the work vehicles and comprises at least two ballast clearing elements spaced from each other in the operating direction and displaceable transversely thereto into the shoulder of the track adjacent respective tie ends, drive means for transversely displacing the ballast clearing elements, and drives for independently vertically adjusting and longitudinally displacing in the operating direction each one of the ballast clearing elements for clearing the ballast for support of the new ties and of the cribs between the new ties.

11. The mobile apparatus of claim 4, further comprising a tie tamping device longitudinally displaceably mounted in the recessed frame portion of one of the work vehicles, the tie tamping device comprising a self-propelled carrier frame supported by two undercarriages on the railroad track, a tamping head mounted on the carrier frame for tamping ballast under respective ones of the new ties, and an operator's cab on the carrier frame.

12. The mobile apparatus of claim 11, wherein a respective one of the tamping heads is associated with each rail of the railroad track and each tamping head has pairs of reciprocatory tamping tools for tamping ballast under the respective new tie disposed therebetween, and further comprising a tie positioning device arranged between the tamping heads for positioning the new tie, and drives connecting the tie positioning device to the carrier frame for vertically and transversely adjusting the tie positioning device.

13. The mobile apparatus of claim 4, wherein each swivel truck has two axles spaced from each other in the operating direction by a distance corresponding to at least three crib widths.

14. The mobile apparatus of claim 13, further comprising a guide means connected to the axles and including guide elements engaging both rails of the railroad track for forcibly guiding the swivel trucks along the railroad track.

15. The mobile apparatus of claim 1, wherein one of the tie exchanging devices is a track-bound self-propelled ballast clearing device longitudinally displaceably mounted in the recessed frame portion of a first one of the work vehicles and comprises a ballast clearing element, a lifting plate arranged to engage a rail head of of a respective rail of the railroad track, and a tie puller arranged to pull a respective one of the ties laterally out of the track by a distance corresponding to at least a third of the length of the tie.

16. The mobile apparatus of claim 1, wherein one of the tie exchanging devices is a tie plate transporting device preceding in the operating direction a first one of the tie pulling and inserting devices and longitudinally displaceably mounted in the recessed frame portion of a second one of the work vehicles, the tie plate transporting device comprising a vertically adjustable magnet connected to a vertical adjustment drive.

17. The mobile apparatus of claim 1, wherein the auxiliary carrier frame with the tie pulling and inserting device and the associated vertical tie conveyor and tie transporting device forms a structural unit, one end of the auxiliary carrier frame being linked to the recessed frame portion of the respective work vehicle and an opposite end thereof being supported on the railroad track by an undercarriage, and further comprising a lifting drive for vertically adjusting the auxiliary carrier frame, the vertical tie conveyor and the tie transporting device consisting of an endless conveyor band being stationarily fixed to the auxiliary carrier frame and the displacing drive connecting the tie pulling and inserting device to the auxiliary carrier frame for displacement relative thereto.

18. The mobile apparatus of claim 1, wherein the tie pulling and inserting device comprises a tie gripping means including a tie clamp, a drive for operating the tie clamp and a drive for vertically displacing the tie clamp, a carriage supporting the tie gripping means for 180° rotation about a vertical axis, a drive for rotating the carriage, the carriage being longitudinally displaceable along a guide track on the auxiliary carrier frame in the operating direction, a guide element extending transversely to the auxiliary carrier frame and telescopingly receiving the tie gripping means, the tie gripping means being displaceable in said transversely extending guide element, and a drive for displacing the tie gripping means in the guide element.

19. The mobile apparatus of claim 18, wherein the tie transporting device comprises an endless tie collecting conveyor band extending below and parallel to the auxiliary carrier frame in the operating direction, a drive for operating the conveyor band, a vertically adjustable clamping means for gripping ties deposited on the endless conveyor band, and a drive for vertically adjusting the clamping means, the clamping means being transversely displaceably mounted on the carriage.

20. The mobile apparatus of claim 19, wherein one end of the auxiliary carrier frame is linked to the recessed frame portion of the respective work vehicle and an opposite end thereof is supported on the railroad track by an undercarriage, and the vertical tie conveyor comprises two vertically adjustable fork lift elements arranged to support opposite ends of ties deposited on the endless conveyor band, the fork lift elements extending through an opening in the one end of the auxiliary carrier frame and the opening having a width corresponding at least to a tie length, a drive for vertically adjusting the fork lift elements between a lower and an upper end position, two L-shaped tie retaining ledges mounted on the work vehicle frame for pivoting about an axis extending in the operating direction, the tie retaining ledges extending in said direction at the level of the upper end position of the fork lift elements and being spaced a distance substantially corresponding to a tie length, and a drive means for pivoting the ledges between a tie retaining and tie releasing position.

21. The mobile apparatus of claim 19, further comprising vertically adjustable support rollers arranged at least at one side of the endless conveyor band, the support rollers being rotatable about axes extending in the operating direction, support arms linking the support rollers to an underside of the carriage, and drive means for pivoting the support arms for vertically adjusting the support rollers.

22. The mobile apparatus of claim 1, wherein one end of the auxiliary carrier frame is linked to the recessed frame portion of the respective work vehicle and an opposite end thereof is supported on the railroad track by an undercarriage, and further comprising a hold-down clamping means adjacent the undercarriage, the clamping means being arranged for clampingly engaging at least one rail head of the railroad track, and a drive for operating the clamping means.

23. The mobile apparatus of claim 22, wherein the rail head clamping means is connected to the tie pulling and inserting device.

24. A method for sequentially exchanging selected consecutive groups of old ties for groups of new ties while retaining groups of old ties between the selected old ties in a railroad track consisting of two rails fastened to the ties supported on ballast, which comprises the steps of (a) continuously advancing at least one elongated bridge-like work vehicle along the track in an operating direction while supporting respective opposite ends of the work vehicle on the track on respective swivel trucks,.

(b) sequentially operating a succession of different individual devices displaceably mounted on the work vehicle in the operating direction between the swivel trucks while continously advancing the work vehicle to (1) remove spikes fastening the rails to the selected old ties whereby the selected old ties are detached from the rails, (2) clear the ballast adjacent an end of the selected old ties from which the spikes have been removed to provide an area free of ballast adjacent the tie end, (3) withdraw the detached old ties laterally from the track to about at least a third of their length while lifting the railroad track, (4) pull the partially withdrawn old ties laterally completely out of the railroad track, (5) clear and plane the ballast in an area whence the old ties have been withdrawn, (6) insert the new ties in the cleared and planed ballast area, and (7) tamp ballast under the new ties, (c) collecting the removed spikes, (d) collecting tie plates from the old ties, (e) transporting the withdrawn old ties to a freight car continuously advancing with the work vehicle, (f) transporting and conveying the new ties sequentially to said area from a freight car continuously advancing with the work vehicle, (g) placing the tie plates between the new ties and the rails, and (h) intermittently displacing the different individual operating devices along the elongated work vehicle for effectuating the sequential operation thereof while the work vehicle advances continuously.

25. The method of claim 24, wherein the new ties are first partially inserted laterally into the track to about at least a third of their length and that the partially inserted new ties are then completely inserted into the track and positioned for tamping at a section of the track where the tamping is effectuated.

26. The method of claim 24, wherein the new ties are stacked in a layered stack preceding the insertion of the new ties, and the new ties are sequentially conveyed from the layered stack for insertion.

* * * * *